US005878958A

United States Patent [19]

Lambert

[11] Patent Number: 5,878,958

[45] Date of Patent: Mar. 9, 1999

[54] FUEL PUMPING APPARATUS

[75] Inventor: Malcolm David Dick Lambert, Bromley, Great Britain

[73] Assignee: Lucas Industries public limited, England

[21] Appl. No.: 898,447

[22] Filed: Jul. 22, 1997

[30] Foreign Application Priority Data

Jul. 25, 1996 [GB] United Kingdom ..... 9615663

[51] Int. Cl.[6] ..... F02M 45/08

[52] U.S. Cl. ..... 239/88; 239/95

[58] Field of Search ..... 239/88, 89, 90, 239/91, 92, 93, 95, 96, 533.1, 533.2, 533.3, 533.9, 583, 584

[56] References Cited

U.S. PATENT DOCUMENTS

| | | | |
|---|---|---|---|
| 2,408,288 | 9/1946 | Bremser | 239/95 |
| 2,762,654 | 11/1956 | Purchas, Jr. et al. | 239/95 |
| 3,403,861 | 10/1968 | Eidtmann et al. | 239/533 |
| 4,408,718 | 10/1983 | Wich | 239/88 |
| 4,463,725 | 8/1984 | Laufer et al. | 239/88 |
| 4,527,738 | 7/1985 | Martin | 239/90 |
| 4,811,899 | 3/1989 | Egler | 239/5 |
| 5,423,484 | 6/1995 | Zuo | 239/90 |

FOREIGN PATENT DOCUMENTS

| | | | |
|---|---|---|---|
| 541100 | 5/1940 | United Kingdom | 239/88 |
| 2105406 A | 3/1983 | United Kingdom . | |
| 418800 A2 | 3/1991 | United Kingdom . | |

OTHER PUBLICATIONS

European Search Report of Application No. EP 97 30 5209, 23 Oct. 1997.

Translation of European Patent (UK) Under Section 77(6)(a); Date of Publication of the Translation 16 Feb. 1994.

*Primary Examiner*—Andres Kashnikow
*Assistant Examiner*—Jorge S. Bocanegra
*Attorney, Agent, or Firm*—Trexler, Bushnell, Giangiorgi & Blackstone, Ltd.

[57] ABSTRACT

A fuel pumping apparatus is disclosed which comprises a pumping plunger reciprocable within a bore. A spill valve communicates with the bore. A pilot piston is exposed to the fuel pressure within the bore, the pilot piston being arranged to move under the action of the fuel pressure to supply a pilot quantity of fuel to an injector. The pilot piston is arranged so that, in one position, only part of an end face thereof is exposed to the fuel pressure within the bore.

6 Claims, 3 Drawing Sheets

FUEL PUMPING APPARATUS

BACKGROUND

This invention relates to a fuel pumping apparatus for supplying fuel to an internal combustion engine and of the kind comprising a fuel pumping plunger which is slidably mounted in a plunger bore formed in a body, a fuel injection nozzle carried by the body and including a valve member which is resiliently biased into engagement with a seating to prevent flow of fuel through an orifice from a nozzle inlet, the valve member being lifted from the seating by fuel under pressure at the nozzle inlet, a spill valve connected to said plunger bore and passage means through which fuel can flow to the nozzle inlet from said plunger bore.

OBJECTS AND SUMMARY

The object of the invention is to provide such an apparatus in a simple and convenient form.

According to the invention an apparatus of the kind specified comprises a pilot pump including a spring biased pilot piston having an end face, the pilot piston being moved from a first position to a second position against the action of the spring bias, by fuel under pressure applied to said end face and displaced from the bore by the pumping plunger when the spill valve is closed, said pilot pump during at least part of the movement of the pilot piston between the first and the second positions, delivering a pilot quantity of fuel to said passage means, said pilot piston at its second position connecting said passage means with the plunger bore to allow for the main delivery of fuel to said passage means and said pilot piston when at its first position, having part of its end face shielded from the fuel pressure in the plunger bore.

BRIEF DESCRIPTION OF THE DRAWINGS

An example of a pumping apparatus in accordance with the invention will now be described with reference to the accompanying drawings in which.

DESCRIPTION

Figure 1:
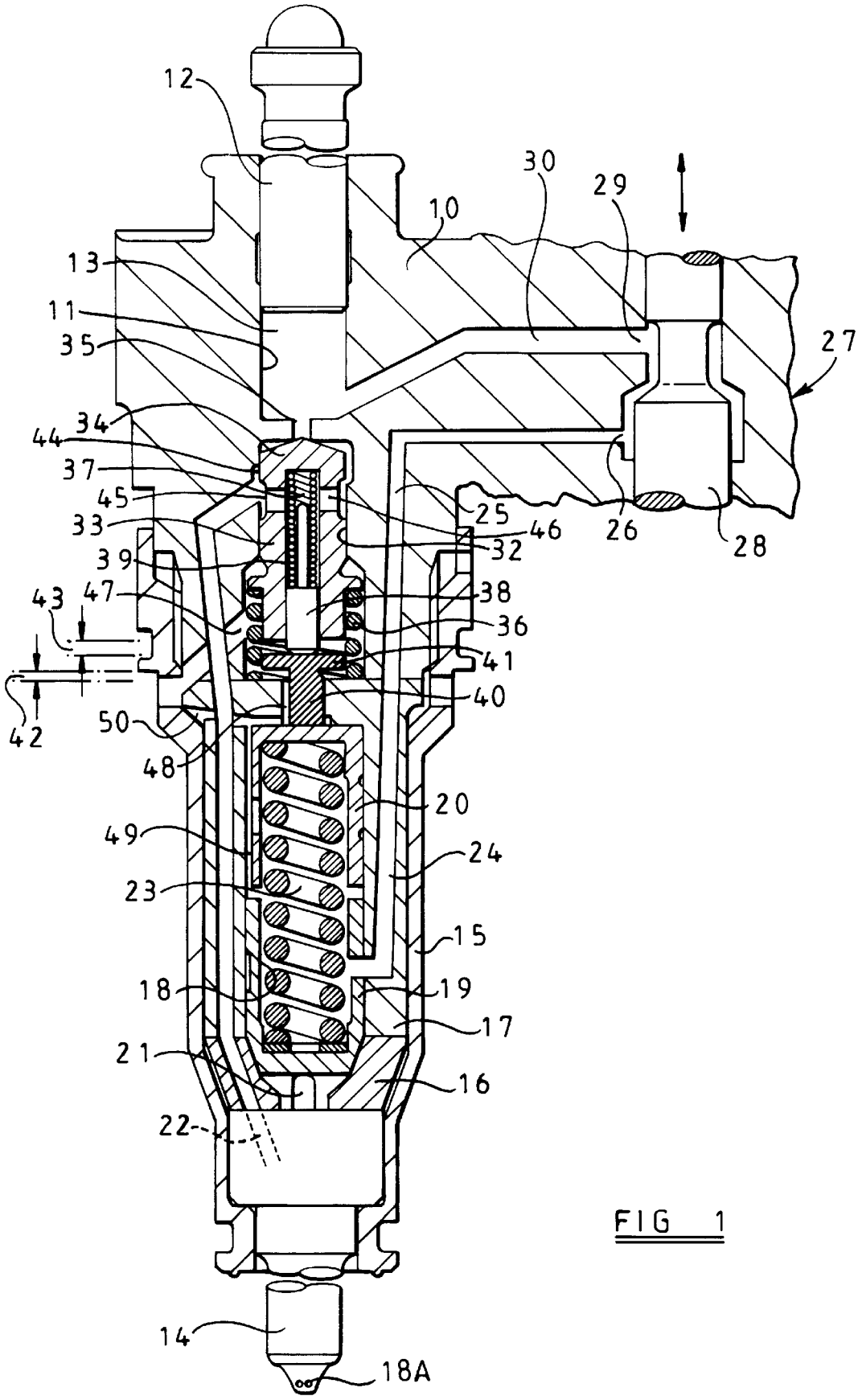
FIG. 1 is a sectional side elevation.

The apparatus comprises a body 10 in which is formed a plunger bore 11. A pumping plunger 12 is slidably mounted in the bore and forms with the inner end of the bore, a pump chamber 13. The pumping plunger projects from the bore and is biased outwardly of the bore in known manner, by a plunger return spring (not shown). The plunger in use is driven inwardly against the action of the spring by an engine driven cam also not shown.

The apparatus also includes a fuel injection nozzle having a stepped body 14, the wider portion of which is engaged by a cap nut 15 which is in screw thread engagement with the body 10. Interposed between the nozzle body and the body 10, is a distance piece 16 which is located next to the nozzle body and a spring housing 17 which is positioned intermediate the distance piece and the body 10.

The fuel injection nozzle includes a valve member of the inwardly opening type which is engagable with a seating defined in the nozzle body, to prevent flow of fuel through an outlet orifice or orifices 18A. The valve member is biased into engagement with the seating by a coiled compression spring 23 which is interposed between a pair of cup shaped spring abutments 19, 20 which are slidable in the manner of pistons, within a cylindrical recess which extends longitudinally within the spring housing 17. The abutment 19 engages with a reduced portion 21 of the nozzle valve member, the reduced portion extending with clearance through an opening formed in the distance piece 16. The space about the distance piece is vented to a drain. The nozzle valve member is lifted from the seating against the action of the spring 23 by a force developed by fuel under pressure supplied to a nozzle inlet 22, and which acts upon a small area of the nozzle valve member.

The space 18 defined between the spring abutments 19, 20 is connected by means of a passage 24 in the spring housing and a further passage 25 in the body 10, with a flow connection 26 of a spill valve 27. The spill valve includes a valve member 28 which is urged into engagement with a seating by energising an electromagnetic actuator not shown. When the actuator is de-energised, the valve member is lifted from the seating by means of a spring, to place the flow connection 26 in communication with a further flow connection 29 which is in communication with the pump chamber 13 by way of a passage 30.

Formed in the body 10 is a cylindrical stepped blind drilling 32 the wider and open end of which is closed by the end face of the spring housing 17. Slidable in the narrower portion of the drilling is a pilot piston 33 which has an end face 34 adjacent the blind end of the drilling, of generally conical form. The inner portion of the end face 34 serves as a closure for an orifice 35 which extends between the blind end of the drilling and the pump chamber 13. The pilot piston is urged to a first position in which the orifice 35 is closed by means of a coiled compression spring 36 which is interposed between a flange on the pilot piston and the end face of the spring housing, the spring being located in the wider portion of the drilling 32.

Figure 2:
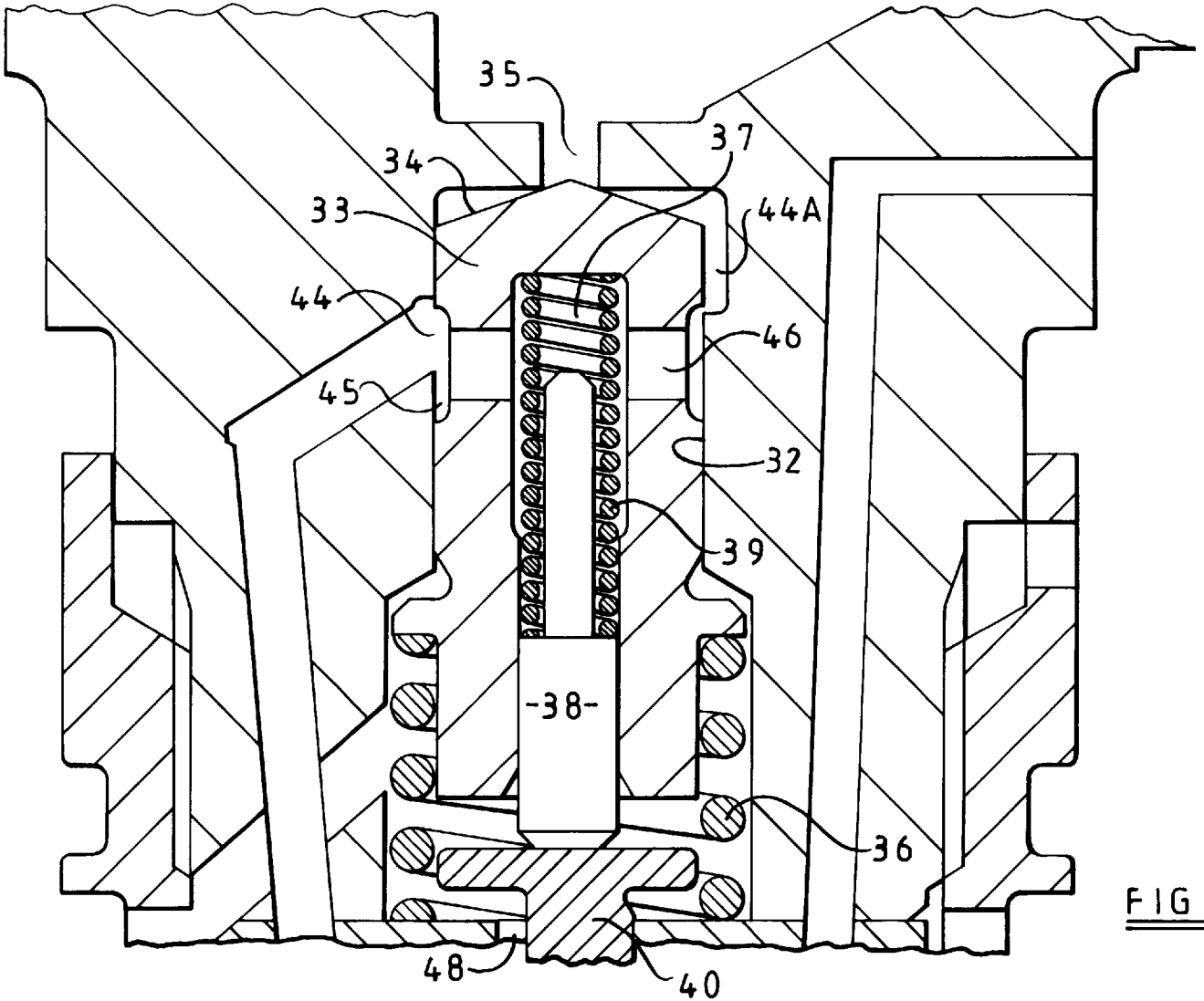
FIGS. 2 and 3 show enlarged views of part of the apparatus seen in FIG. 1 at different times during the operating cycle.

Formed in the pilot piston 33 is a further blind drilling 37 having its open end facing towards the spring housing and slidable in this drilling is a piston member 38. The piston member is biased outwardly by means of a further spring 39 interposed between the piston member and the blind end of the drilling 37. In the rest position of the apparatus as shown in FIGS. 1 and 2, the piston member 38 projects from the drilling 37 and engages a peg 40. The peg 40 is slidably mounted in an opening formed in the end face of the spring housing and it engages the spring abutment 20. The peg is provided with a flange 41 which lies within the coils of the spring 36 and in the rest position, a clearance 42 is established between the flange and the end face of the spring housing. The flange 41 can be engaged as will be described, by the skirt of the pilot piston 33 in the second position thereof, a clearance 43 being established therebetween in the rest position.

Formed in the wall of the narrower portion of the drilling 32 and as best seen in FIG. 2, is a port 44 which is spaced from the blind end of the drilling. The port in the rest position of the apparatus is covered by the pilot piston 33. The port 44 communicates with the nozzle inlet 22 by way of communicating passages in the body 10, the spring housing 17 and the distance piece 16. Moreover, in the periphery of the pilot piston 33 is formed a circumferential groove 45 which communicates with ports 46 which extend through the skirt of the pilot piston into the blind end of the drilling 37. Also formed in the narrower part of the drilling is a slot 44A which in the rest position of the pilot piston is uncovered to the groove 45.

The wider end of the drilling 32 communicates with a fuel inlet passage 47 and this by way of openings formed in the skirt of the cap nut, communicates in use with a fuel supply passage formed in the cylinder head of the associated engine.

The peg 40 is fluted and defines longitudinal grooves 48 in its wall. The grooves communicate with a further longitudinal groove 49 formed in the outer wall of the spring abutment 20. At the point of communication of the grooves 48 and 49 is a restricted passage 50 which communicates by way of the openings in the skirt of the cap nut, with the fuel supply. The remote end of the groove 49 communicates with the space 18 defined between the two spring abutments and intermediate its ends the skirt of the spring abutment 20 is provided with openings into the groove.

The operation of the apparatus will now be described. FIGS. 1 and 2 show the parts of the apparatus in the rest position and assuming that the engine driven cam starts to move the plunger inwardly, fuel will be displaced from the pump chamber 13 and will flow by way of the spill valve 27 to the space 18 and from the space by way of the grooves 48 and 49 to the fuel supply passage 47. Some fuel can also flow through the restricted passage 50.

Figure 3:
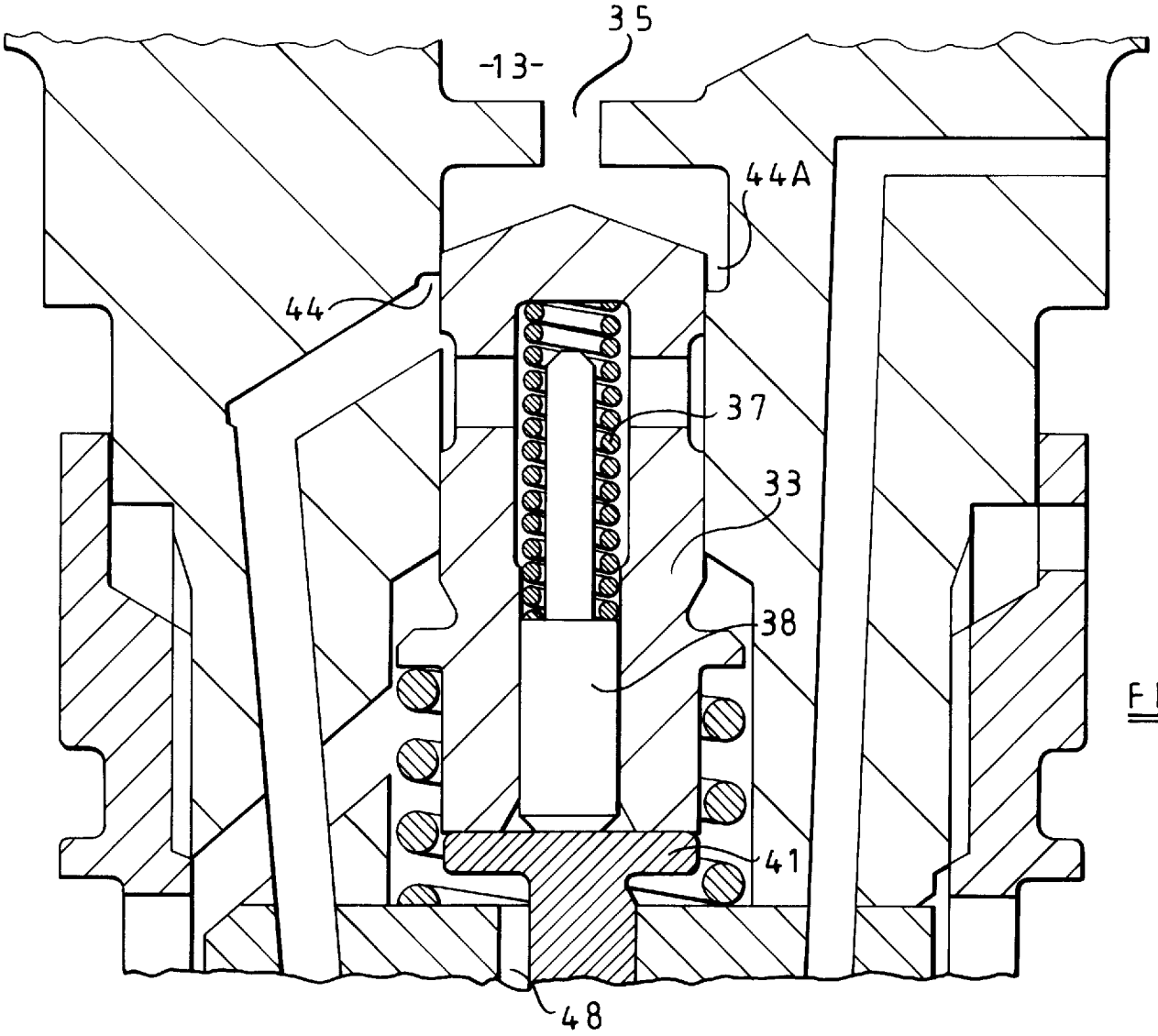

When during the inward movement of the plunger the spill valve 27 is closed, the flow of fuel as described can no longer take place and the fuel pressure in the pump chamber 13 starts to rise. This fuel pressure acts upon the portion of the conical end face 34 of the pilot piston which lies within the circumference of the orifice 35 and when the fuel pressure rises to a sufficiently high value, the pilot piston is displaced from the orifice and the fuel pressure then acts against the whole end face 34 of the pilot piston to cause rapid movement of the piston against the action of the spring 36 and also the spring 39. During the initial movement of the pilot piston the slot 44A is uncovered and fuel is displaced from the blind drilling 37 into the narrower end of the drilling 32. When the slot 44A is covered the fuel displaced from the blind drilling 37 flows through the ports 46, the groove 45 and the port 44 to the nozzle inlet 22. Due to the difference in end areas of the pilot piston 33 and the piston member 38 pressure intensification takes place so that the fuel pressure at the nozzle inlet 22 is higher than that in the pump chamber 13. When the fuel pressure at the nozzle inlet 22 attains a sufficiently high value the valve member of the fuel injection nozzle is lifted away from its seating against the action of the spring 23 and fuel delivery takes place through the orifices 18A. This flow of fuel continues until the pilot piston 33 engages the flange 41 having moved through a distance corresponding to the clearance 43. This position is shown in FIG. 3. During the movement of the pilot piston fuel is displaced from the wider portion of the drilling 32 to the fuel inlet passage 47. It will be noted from FIG. 3 that at the point of engagement of the pilot piston 33 with the flange 41, the port 44 is still closed off from the pumping chamber 13. As soon as the pilot piston engages the flange no more fuel is displaced from the blind drilling 37 and therefore the pressure of fuel supplied to the inlet of the injection nozzle falls thereby allowing the valve member of the fuel injection nozzle to close onto its seating.

As the pumping plunger continues to move inwardly, the pressure in the pumping chamber rises to cause further displacement of the pilot piston 33. Since the pilot piston is in engagement with the flange 41, the peg 40 and the spring abutment 20 are also displaced and the pilot piston movement takes place against the action of the spring 36 and also the spring 23. The practical effect is that the force exerted by the spring 23 on the valve member of the fuel injection nozzle is increased and this facilitates closure of the valve member onto the seating. Moreover, a higher fuel pressure will be required to lift the valve member of the fuel injection nozzle from its seating for the main delivery of fuel than was required for the pilot injection of fuel. A further effect is that the flange 41 is brought into sealing engagement with the end face of the spring housing thereby closing the grooves 48 in the peg 40. Prior to engagement of the flange with the spring housing the port 44 is uncovered by the pilot piston to allow direct communication of the pumping chamber 13 with the inlet 22 of the fuel injection nozzle.

Further inward movement of the pumping plunger 12 raises the fuel pressure at the inlet 22 of the fuel injection nozzle and the valve member thereof eventually lifts from its seating to allow the main delivery of fuel to the engine.

In order to terminate fuel delivery, the spill valve 27 is opened and this has the effect of lowering the pressure of fuel supplied to the inlet 22 of the fuel injection nozzle and since the fuel flow through the spill valve takes place through the space 18, the pressure therein is increased. The increased pressure in the space 18 acting on the spring abutment 19, generates a force acting to assist the spring 23 thereby resulting in rapid closure of the valve member of the fuel injection nozzle. The fuel pressure in the space 18 is controlled by the restricted passage 50 since the grooves 48 are closed, and the spring abutment 20 is largely pressure balanced so far as this pressure is concerned.

At the end of the inward movement of the pumping plunger, the fuel pressure in the pump chamber 13 and the space 18 falls and under the action of the springs 23, 36 and 39, the various parts of the apparatus are returned to the positions shown in FIG. 1. As the pumping plunger moves outwardly, fuel is drawn into the pump chamber 13, this fuel flowing by way of the spill valve 27, the space 18, the grooves 48 and the inlet passage 47. Further fuel flow into the space 18 can also take place through the restricted passage 50. During the return movement of the pilot piston it reaches a position just prior to obturating the orifice 35 at which the port 44 by way of the ports 46 and the slot 44A communicates with the pumping chamber 13. This further lowers the pressure at the inlet 22 of the fuel injection nozzle and also since fuel is being displaced by the movement of the pilot piston there will be sufficient fuel available to fill the blind drilling 37. When the pumping plunger moves inwardly fuel is displaced from the pumping chamber following the route as prescribed above, until the spill valve 27 is closed to initiate delivery of fuel to the engine.

The size of the orifice 35 and the force exerted by the springs 36 and 39, determine the rate of movement of the pilot piston following closure of the spill valve. The size of the orifice 35 determines the area of the pilot piston which is exposed to the pressure in the pump chamber and in conjunction with the force exerted by the springs 36, 39, determines the pressure at which the pilot piston starts to move. In practice the size of the orifice is chosen so that even in engine overrun conditions when the spill valve might never be closed, the pressure of fuel developed in the pumping chamber is not high enough to cause movement of the pilot piston. It is therefore possible to control the start of movement of the pilot piston and hence the timing of the start of fuel delivery over a wide range of engine speeds. In a previous proposal the whole area of the pilot piston was exposed to the pressure of fuel in the pumping chamber and this allowed some movement of the pilot piston to take place before closure of the spill valve particularly at high engine speeds. Thus it was not possible to control the timing of fuel delivery with the required degree of accuracy.

I claim:

1. A fuel pumping apparatus for supplying fuel to an internal combustion engine comprising a fuel pumping plunger which is slidably mounted in a plunger bore formed in a body, a fuel injection nozzle carried by the body and including a valve member which is resiliently biased into engagement with a seating to prevent flow of fuel through an orifice from a nozzle inlet, the valve member being lifted from the seating by fuel under pressure at the nozzle inlet, a spill valve connected to said plunger bore, passage means through which fuel can flow to the nozzle inlet from said plunger bore, a pilot pump including a spring biased pilot piston having an end face, the pilot piston being moved from a first position to a second position against the action of the spring bias by fuel under pressure applied to said end face and displaced from the bore by the pumping plunger when the spill valve is closed, said pilot pump during at least part of the movement of the pilot piston between the first and the second positions, delivering a pilot quantity of fuel to said passage means, said pilot piston at its second position connecting said passage means with the plunger bore to allow for the main delivery of fuel to said passage means and said pilot piston, when at its first position, having part of its end face shielded from the fuel pressure in the plunger bore.

2. A fuel pumping apparatus as claimed in claim 1, wherein the pilot piston is provided with a bore within which a pilot pump plunger is slidable, relative movement of the pilot piston and pilot pump plunger resulting in the delivery of the pilot quantity of fuel to the passage means.

3. A fuel pumping apparatus as claimed in claim 1, wherein the spill valve controls communication between the plunger bore and a chamber housing biasing means for resiliently biasing the valve member into engagement with its seating, the chamber communicating with a source of fuel at low pressure through a restricted passage.

4. A fuel pumping apparatus as claimed in claim 3, further comprising a by-pass passage arranged in parallel with the restricted passage, and valve means controlling communication between the chamber and source of fuel through the by-pass passage.

5. A fuel pumping apparatus as claimed in claim 4, wherein the valve means comprises a peg engageable with the pilot piston, the peg being moveable to break the communication through the by-pass passage upon movement of the pilot piston to its second position.

6. A fuel pumping apparatus as claimed in claim 1, wherein the pilot piston is slidable in a bore which communicates with the plunger bore through a passage of diameter smaller than the pilot piston, the pilot piston closing the passage when occupying its first position.

* * * * *